US009334629B2

(12) United States Patent
Mueller

(10) Patent No.: US 9,334,629 B2
(45) Date of Patent: May 10, 2016

(54) OPEN-CENTER HYDRAULIC SYSTEM WITH MACHINE INFORMATION-BASED FLOW CONTROL

(71) Applicant: DEERE & COMPANY, Moline, IL (US)

(72) Inventor: Jason Lee Mueller, Dubuque, IA (US)

(73) Assignee: DEERE AND COMPANY, Moline, IL (US)

( * ) Notice: Subject to any disclaimer, the term of this patent is extended or adjusted under 35 U.S.C. 154(b) by 447 days.

(21) Appl. No.: 13/840,090

(22) Filed: Mar. 15, 2013

(65) Prior Publication Data

US 2014/0271073 A1 Sep. 18, 2014

(51) Int. Cl.

| | |
|---|---|
| ***E02F 9/22*** | (2006.01) |
| ***E02F 3/96*** | (2006.01) |
| ***E02F 9/08*** | (2006.01) |
| ***E02F 9/16*** | (2006.01) |

(52) U.S. Cl.

CPC ..... *E02F 9/2296* (2013.01); *E02F 3/964* (2013.01); *E02F 9/085* (2013.01); *E02F 9/166* (2013.01); *E02F 9/2235* (2013.01)

(58) Field of Classification Search

CPC ..... F15B 11/165; F04B 49/002; E02F 9/2235
USPC ..... 60/445, 452
See application file for complete search history.

(56) References Cited

U.S. PATENT DOCUMENTS

| | | | | |
|---|---|---|---|---|
| 3,788,077 A | | 1/1974 | Johnson et al. | |
| 3,981,630 A | | 9/1976 | Leduc et al. | |
| 4,255,092 A | | 3/1981 | Hudson et al. | |
| 4,669,947 A | * | 6/1987 | Frost | 414/724 |
| 5,048,628 A | | 9/1991 | Rayner | |
| 5,159,812 A | * | 11/1992 | Nikolaus | 60/445 |
| 5,187,933 A | * | 2/1993 | Nikolaus | 60/452 |
| 5,345,764 A | | 9/1994 | Phillips | |
| 5,490,383 A | | 2/1996 | Muller et al. | |
| 5,505,275 A | | 4/1996 | Phillips | |
| 5,743,089 A | * | 4/1998 | Tohji | 60/450 |
| 6,068,451 A | | 5/2000 | Uppal | |
| 6,119,967 A | * | 9/2000 | Nakayama et al. | 241/34 |
| 6,170,262 B1 | * | 1/2001 | Yoshimura et al. | 60/452 |
| 6,202,411 B1 | * | 3/2001 | Yamashita | 60/445 |
| 6,244,158 B1 | | 6/2001 | Roche | |
| 8,016,068 B2 | * | 9/2011 | Daniel et al. | 180/306 |

(Continued)

FOREIGN PATENT DOCUMENTS

EP 0042682 A1 12/1981

OTHER PUBLICATIONS

Web Article "Two Types of Equipment Buyers Drive Backhoe Design", Larry Stewart, http://www.buyerzone.com/construction-equipment/backhoe-loaders/ar-backhoe-design/, dated Apr. 1, 2006 and accessed Jan. 20, 2011.

Product Brochure—Axial piston variable pump with electro-proportional control A10VO EP/EK, Rexroth Bosch Group, revised Mar. 2008.

*Primary Examiner* — Thomas E Lazo

(74) *Attorney, Agent, or Firm* — Taft Stettinius & Hollister LLP; Stephen F. Rost

(57) ABSTRACT

A work vehicle is provided including at least one work tool and an open-center hydraulic circuit that supplies hydraulic fluid to operate the at least one work tool. The hydraulic circuit includes a variable displacement pump and a controller in electrical communication with the pump, the controller receiving an electrical input from the work vehicle to control the flow of hydraulic fluid from the pump.

20 Claims, 5 Drawing Sheets

(56) References Cited

U.S. PATENT DOCUMENTS

| | | | | |
|---|---|---|---|---|
| 8,393,150 | B2 * | 3/2013 | Brickner et al. | 60/452 |
| 2007/0006580 | A1 | 1/2007 | Hesse | |
| 2009/0031721 | A1 * | 2/2009 | Palo | 60/449 |
| 2009/0301797 | A1 | 12/2009 | Smith | |
| 2010/0018796 | A1 | 1/2010 | Peterson | |
| 2010/0242464 | A1 * | 9/2010 | Vigholm | E02F 9/2228 60/327 |
| 2011/0262227 | A1 * | 10/2011 | Christ et al. | 404/84.05 |

* cited by examiner

OPEN-CENTER HYDRAULIC SYSTEM WITH MACHINE INFORMATION-BASED FLOW CONTROL

FIELD OF THE DISCLOSURE

The present disclosure relates to a work vehicle having an open-center hydraulic system. More particularly, the present disclosure relates to a work vehicle having an open-center hydraulic system with machine information-based flow control, and to a method for using the same.

BACKGROUND OF THE DISCLOSURE

The U.S. Environmental Protection Agency (EPA) has adopted a comprehensive program to reduce emissions from future off-highway work vehicles. The engines of such off-highway work vehicles are being modified to satisfy the EPA's emissions regulations. However, these modified engines have been shown to impact vehicle performance, such as by exhibiting slower transient response times compared to current engines. In the case of a backhoe loader having a rear-mounted bucket and a front-mounted bucket, for example, the modified engine may be slow to respond to an operator's request for additional hydraulic power to lift the buckets.

SUMMARY

The present disclosure provides a work vehicle including at least one work tool and an open-center hydraulic circuit that supplies hydraulic fluid to operate the at least one work tool. The hydraulic circuit includes a variable displacement pump and a controller in electrical communication with the pump, the controller receiving an electrical input from the work vehicle to control the flow of hydraulic fluid from the pump.

According to an embodiment of the present disclosure, a work vehicle is provided including a chassis, a plurality of fraction devices positioned to support the chassis on the ground, a power source, a variable displacement pump that is driven by the power source to supply hydraulic fluid, a pump control valve operably coupled to the pump and configured to adjust the displacement of the pump, at least one work tool moveably coupled to the chassis, at least one hydraulic actuator configured to move the at least one work tool relative to the chassis, an open-center actuator control valve in communication with the pump and the at least one hydraulic actuator, the open-center actuator control valve directing hydraulic fluid away from the at least one hydraulic actuator when in a neutral position and directing hydraulic fluid to the at least one hydraulic actuator when in an actuated position to move the at least one work tool relative to the chassis, and a controller in electrical communication with the pump control valve, the controller receiving an electrical input from the work vehicle and sending an electrical control signal to the pump control valve based on the electrical input to adjust the flow rate of hydraulic fluid supplied to the open-center actuator control valve.

According to another embodiment of the present disclosure, a work vehicle is provided including a chassis, a plurality of traction devices positioned to support the chassis on the ground, a power source, at least one work tool moveably coupled to the chassis, a hydraulic circuit, and an electrical circuit. The hydraulic circuit includes a variable displacement pump that is driven by the power source to supply hydraulic fluid, a pump control valve operably coupled to the pump and configured to adjust the displacement of the pump, at least one hydraulic actuator configured to move the at least one work tool relative to the chassis, and an open-center actuator control valve in communication with the pump and the at least one hydraulic actuator, the open-center actuator control valve directing hydraulic fluid away from the at least one hydraulic actuator when in a neutral position and directing hydraulic fluid to the at least one hydraulic actuator when in an actuated position to move the at least one work tool relative to the chassis. The electrical circuit includes at least one input device and a controller in electrical communication with the at least one input device and the pump control valve, the controller receiving an electrical input from the at least one input device and sending an electrical control signal to the pump control valve based on the electrical input from the at least one input device to adjust the flow rate of hydraulic fluid supplied to the open-center actuator control valve.

According to yet another embodiment of the present disclosure, a method is provided for operating a work vehicle, the work vehicle having a chassis, a plurality of traction devices positioned to support the chassis on the ground, a power source, a variable displacement pump that is driven by the power source, at least one work tool moveably coupled to the chassis, and at least one hydraulic actuator. The method includes the steps of communicating an electrical input to a controller of the work vehicle, sending an electrical control signal from the controller to a pump control valve based on the electrical input, operating the pump control valve based on the electrical control signal to adjust the displacement of the pump, supplying hydraulic fluid from the pump to an open-center actuator control valve, and directing hydraulic fluid from the open-center actuator control valve to the at least one hydraulic actuator to move the at least one work tool relative to the chassis.

BRIEF DESCRIPTION OF THE DRAWINGS

The above-mentioned and other features and advantages of this disclosure, and the manner of attaining them, will become more apparent and the disclosure itself will be better understood by reference to the following description of embodiments of the disclosure taken in conjunction with the accompanying drawings, wherein.

Corresponding reference characters indicate corresponding parts throughout the several views. The exemplifications set out herein illustrate exemplary embodiments of the disclosure and such exemplifications are not to be construed as limiting the scope of the invention in any manner.

DETAILED DESCRIPTION

Figure 1:
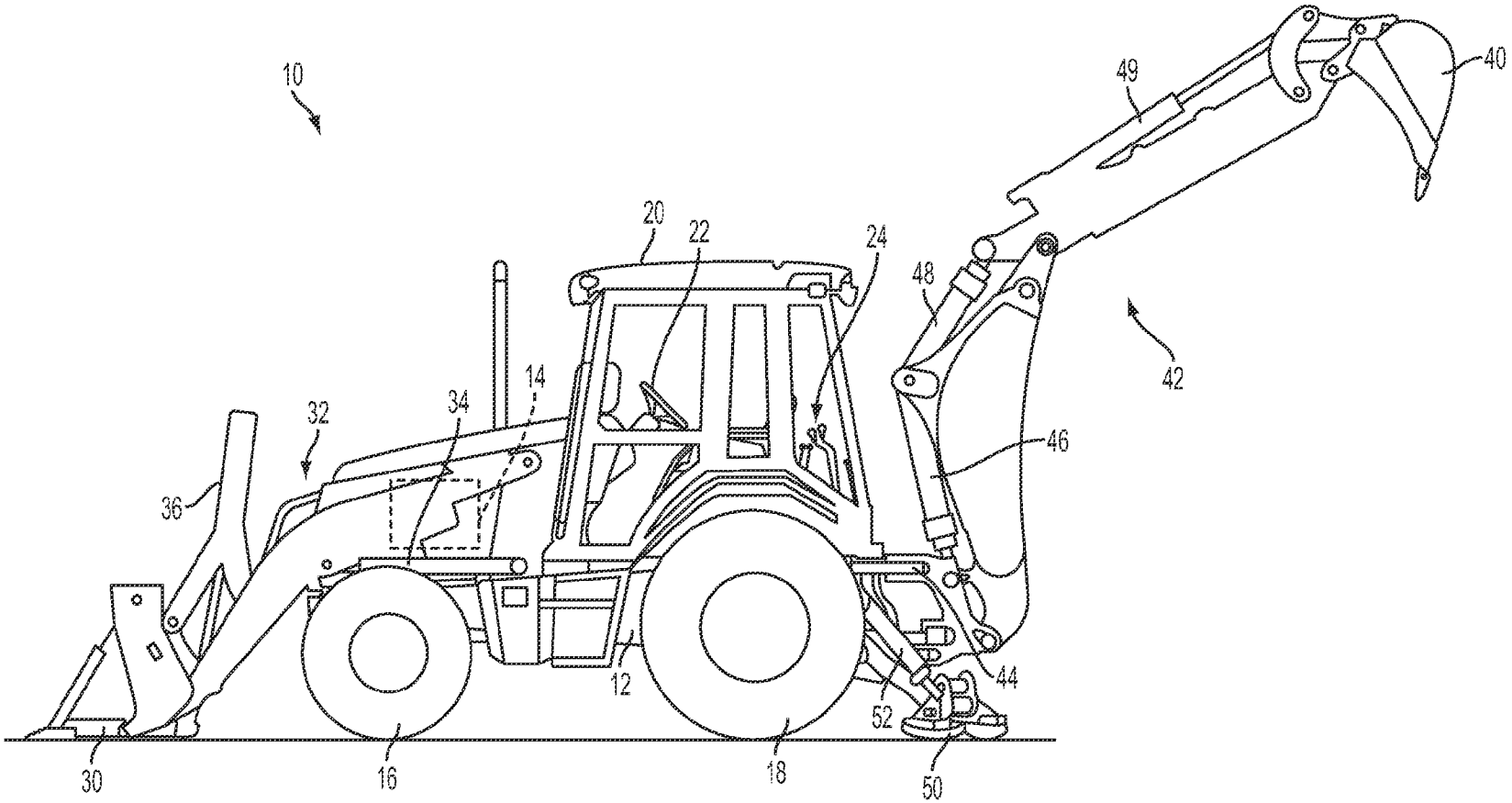
FIG. 1 is a side elevational view of a work vehicle in the form of a loader backhoe.

Referring to FIG. 1, a work vehicle 10 is provided in the form of a loader backhoe. Although vehicle 10 is illustrated and described herein as a loader backhoe, vehicle 10 may also be in the form of a bulldozer, a motor grader, an excavator, or another agricultural or utility vehicle, for example. Vehicle 10 includes chassis 12, a power source or engine 14, and a plurality of traction devices, illustratively front wheels 16 and rear wheels 18. It is also within the scope of the present disclosure that the traction devices of vehicle 10 may include belts or steel tracks, for example. In use, engine 14 drives the front and/or rear wheels 16 and 18 via a transmission (not shown), causing vehicle 10 to propel across the ground.

Vehicle 10 of FIG. 1 also includes operator cab 20 supported by chassis 12 to house and protect the operator of vehicle 10. Operator cab 20 may include a rotatable seat (not shown), foot pedals (not shown), steering wheel 22, joysticks 24, monitors (not shown), and any other controls or user inputs necessary to operate vehicle 10.

Vehicle 10 of FIG. 1 further includes at least one work tool, illustratively a front-mounted bucket 30 (i.e., a loader) and a rear-mounted bucket 40 (i.e., a backhoe). Other suitable work tools include, for example, blades, forks, tillers, and mowers. Buckets 30 and 40 are moveably coupled to chassis 12 for scooping, carrying, and dumping dirt and other materials. As shown in FIG. 1, the front-mounted bucket 30 is moveably coupled to the front end of chassis 12 via a first boom assembly 32, which includes a plurality of hydraulic actuators for moving the front-mounted bucket 30 relative to chassis 12. The illustrative first boom assembly 32 includes hydraulic lift cylinders 34 for raising and lowering the first boom assembly 32 and a hydraulic tilt cylinder 36 for tilting (e.g. digging and dumping) bucket 30. The rear-mounted bucket 40 is moveably coupled to the rear end of chassis 12 via a second boom assembly 42, which includes a plurality of hydraulic actuators for moving the rear-mounted bucket 40 relative to chassis 12. The illustrative second boom assembly 42 includes a plurality of hydraulic swing cylinders 44 for swinging the second boom assembly 42 side to side, a hydraulic lift cylinder 46 for raising and lowering the second boom assembly 42, a hydraulic crowd cylinder 48 for bending the second boom assembly 42, and a hydraulic tilt cylinder 49 for tilting (e.g. digging and dumping) bucket 40. The operator may control movement of buckets 30 and 40 using controls located within operator cab 20, such as joysticks 24.

Vehicle 10 of FIG. 1 still further includes right-side and left-side stabilizers 50 for supporting and stabilizing vehicle 10 on the ground, especially when operating buckets 30 and 40. Hydraulic lift cylinders 52 are shown in FIG. 1 for raising and lowering stabilizers 50 relative to chassis 12 of vehicle 10.

Figure 2:
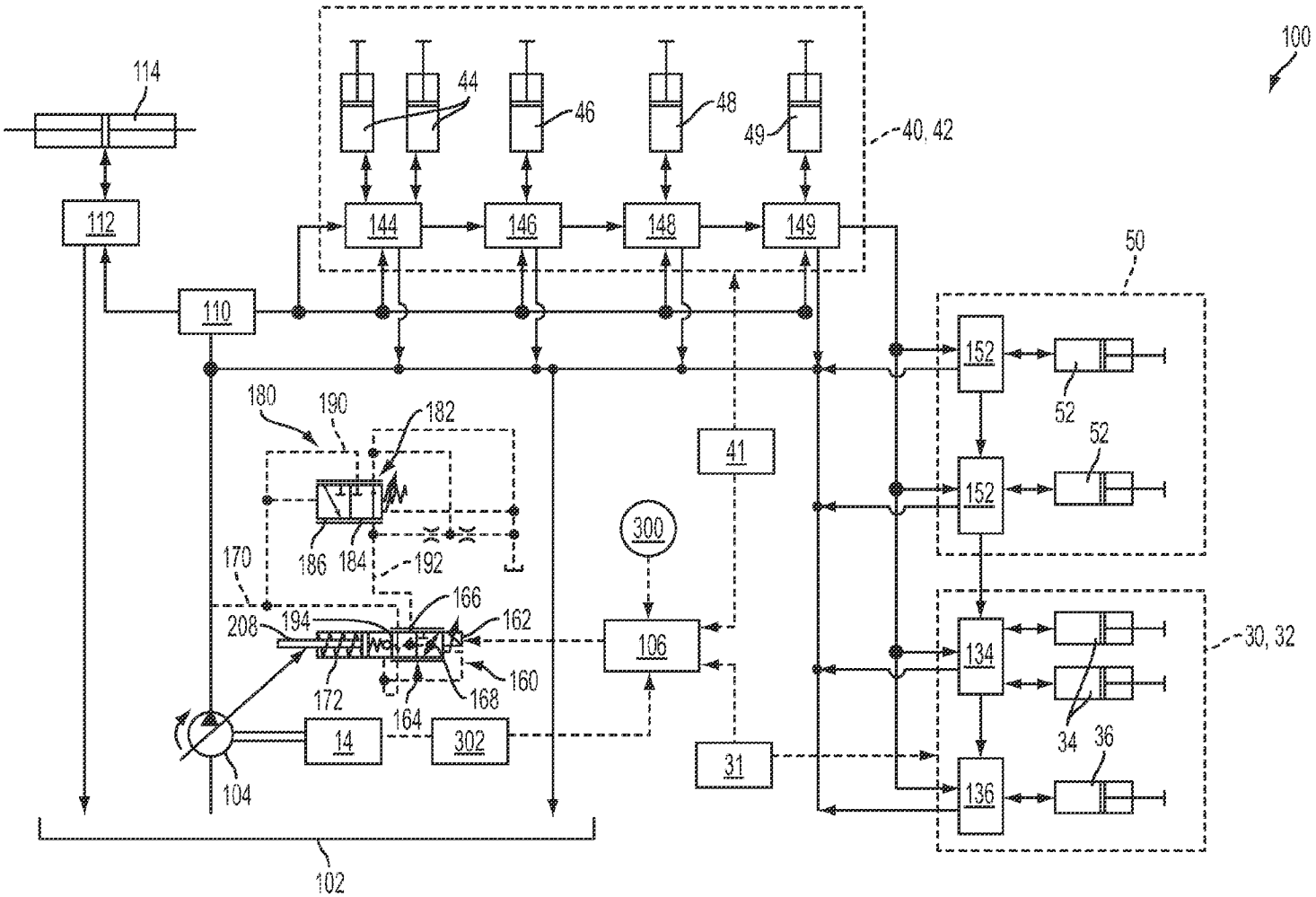
FIG. 2 is a schematic view of an exemplary hydraulic circuit for operating the work vehicle of FIG. 1.

Referring next to FIG. 2, an open-center hydraulic circuit 100 is provided to operate vehicle 10. Circuit 100 of FIG. 2 includes a hydraulic fluid tank 102 and a variable displacement pump 104 that is driven by engine 14 to deliver pressurized hydraulic fluid from tank 102 to priority valve 110. Engine 14 may drive pump 104 at a speed of about 2200 rpm, for example. Circuit 100 of FIG. 2 also includes a master controller 106, which is discussed further below.

Depending on the position of the proportional priority valve 110, the pressurized hydraulic fluid in circuit 100 may be directed to steer vehicle 10, to operate the front-mounted bucket 30, to operate the rear-mounted bucket 40, and/or to operate stabilizers 50. To steer vehicle 10, circuit 100 includes steering valve 112 for operating hydraulic steering cylinder 114. To move the rear-mounted bucket 40 and the second boom assembly 42, circuit 100 includes swing valve 144 for operating hydraulic swing cylinders 44, lift valve 146 for operating hydraulic lift cylinder 46, crowd valve 148 for operating hydraulic crowd cylinder 48, and tilt valve 149 for operating hydraulic tilt cylinder 49. To move the front-mounted bucket 30 and the first boom assembly 32, circuit 100 includes lift valve 134 for operating hydraulic lift cylinders 34 and tilt valve 136 for operating hydraulic tilt cylinder 36. To move stabilizers 50, circuit 100 includes lift valves 152 for operating hydraulic lift cylinders 52. Although the illustrative circuit 100 of FIG. 2 is configured to steer vehicle 10, to operate the front-mounted bucket 30, to operate the rear-mounted bucket 40, and to operate stabilizers 50, circuit 100 may also be configured to operate other hydraulic components of vehicle 10.

Because circuit 100 is an open-center system, the hydraulic fluid that is not used to steer vehicle 10, to operate the front-mounted bucket 30, to operate the rear-mounted bucket 40, or to operate stabilizers 50 is returned to tank 102. In this embodiment, steering valve 112, swing valve 144, lift valve 146, crowd valve 148, tilt valve 149, lift valve 134, tilt valve 136, and/or lift valves 152 of circuit 100 may be open-center valves that provide an open return path for hydraulic fluid downstream and eventually to tank 102 when in their neutral positions. For example, when swing valve 144 of circuit 100 is in a neutral, centered position, swing valve 144 may direct hydraulic fluid downstream and away from hydraulic swing cylinders 44, and eventually to tank 102. An exemplary open-center valve for use in circuit 100 is the 6000 series valve available from HUSCO International, Inc. of Waukesha, Wis.

The hydraulic fluid that is used to steer vehicle 10, to operate the front-mounted bucket 30, to operate the rear-mounted bucket 40, or to operate stabilizers 50 is also returned to tank 102 after use. For example, when swing valve 144 of circuit 100 is in an actuated position, swing valve 144 may direct hydraulic fluid to hydraulic swing cylinders 44 to operate the rear-mounted bucket 40, and then the hydraulic fluid may be exhausted to tank 102 after use.

Figure 3A:
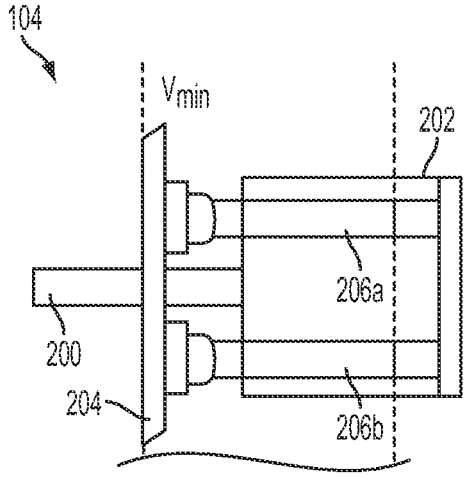
FIG. 3A is a schematic view of an exemplary variable displacement axial piston pump having an adjustable swash plate, the swash plate shown at a minimum swivel angle.
Figure 3B:
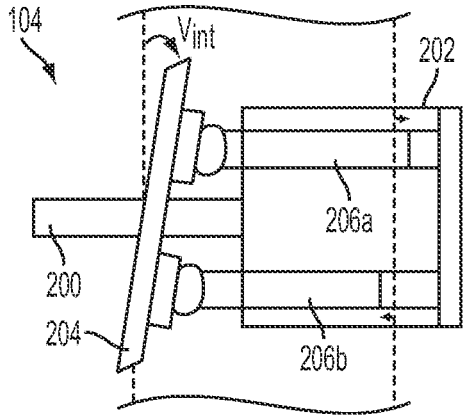
FIG. 3B is a schematic view of the variable displacement axial piston pump that is similar to FIG. 3A, the swash plate shown at an intermediate swivel angle.
Figure 3C:
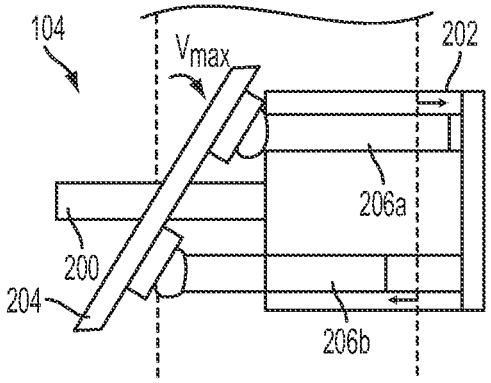
FIG. 3C is a schematic view of the variable displacement axial piston pump that is similar to FIG. 3A, the swash plate shown at a maximum swivel angle.

Referring next to FIGS. 3A-3C, pump 104 is schematically illustrated as a variable displacement axial piston pump. Pump 104 includes shaft 200, barrel 202, an adjustable swash plate 204, and a plurality of pistons 206*a*, 206*b*, arranged longitudinally in barrel 202 and biased toward swash plate 204. When shaft 200 of pump 104 is driven by engine 14 (FIG. 1), shaft 200 rotates barrel 202 and pistons 206*a*, 206*b*, located therein across swash plate 204. To control the volume of hydraulic fluid that is output from pump 104 with each stroke of pistons 206*a*, 206*b*, swash plate 204 may be adjusted from a minimum swivel angle ($V_{min}$=0) (FIG. 3A), to an intermediate swivel angle ($V_{int}$) (FIG. 3B), to a maximum swivel angle ($V_{max}$) (FIG. 3C), and infinitely therebetween. When pistons 206*a*, 206*b*, rotate across swash plate 204 at its minimum swivel angle ($V_{min}$=0) (FIG. 3A), pistons 206*a*, 206*b*, are not forced through barrel 202, so no hydraulic fluid is delivered from pump 104, even if pump 104 is being driven by engine 14. When pistons 206*a*, 206*b*, rotate across swash plate 204 that has been tilted to its intermediate swivel angle ($V_{int}$) (FIG. 3B), pistons 206*a*, 206*b*, travel in a longitudinal direction through barrel 202 with each stroke to displace hydraulic fluid from pump 104. When pistons 206*a*, 206*b*, rotate across swash plate 204 that has been tilted further to its maximum swivel angle ($V_{max}$) (FIG. 3C), pistons 206*a*, 206*b*, travel a greater distance through barrel 202 with each stroke to displace more hydraulic fluid from pump 104.

An exemplary variable displacement axial piston pump is the Series 53 EP.DF or EK.DF pump available from Bosch Rexroth AG of Horb, Germany. Another suitable pump includes the Parker RDEC pump available from Parker Hannifin Corp. of Marysville, Ohio. Other suitable pumps include displacement controlled pumps, or standard piston pumps having solenoid valves for swash angle manipulation, for example.

Returning to FIG. 2, a spring-biased cylinder 208 is coupled to swash plate 204 of pump 104. The illustrative cylinder 208 is spring-biased to position swash plate 204 at its maximum swivel angle ($V_{max}$). A pressure of at least about 14 bar (200 psi), for example, may be required to overcome the spring-bias of cylinder 208.

A flow controller 160 is provided in FIG. 2 to electrically control the position of swash plate 204. The illustrative flow controller 160 includes solenoid 162 in electrical communication with controller 106 and proportional valve 164 having a neutral, delivery position 166 and a vent position 168. In use, controller 106 sends an electrical signal (e.g., a PWM signal) to solenoid 162 to selectively adjust proportional valve 164 between the neutral, delivery position 166 and the vent position 168. With proportional valve 164 in the neutral, delivery position 166, pressure at the outlet of pump 104 enters proportional valve 164 via line 170 and moves spool 172, forcing swash plate 204 to its minimum swivel angle ($V_{min}$). As discussed above, a pressure of at least about 14 bar (200 psi), for example, may be required to overcome the spring-bias of cylinder 208 and to move swash plate 204 from its spring-biased maximum swivel angle ($V_{max}$) to its minimum swivel angle ($V_{min}$). With proportional valve 164 in the vent position 168, pressure in line 170 does not enter proportional valve 164, allowing swash plate 204 to return to its maximum swivel angle ($V_{max}$).

Figure 4A:
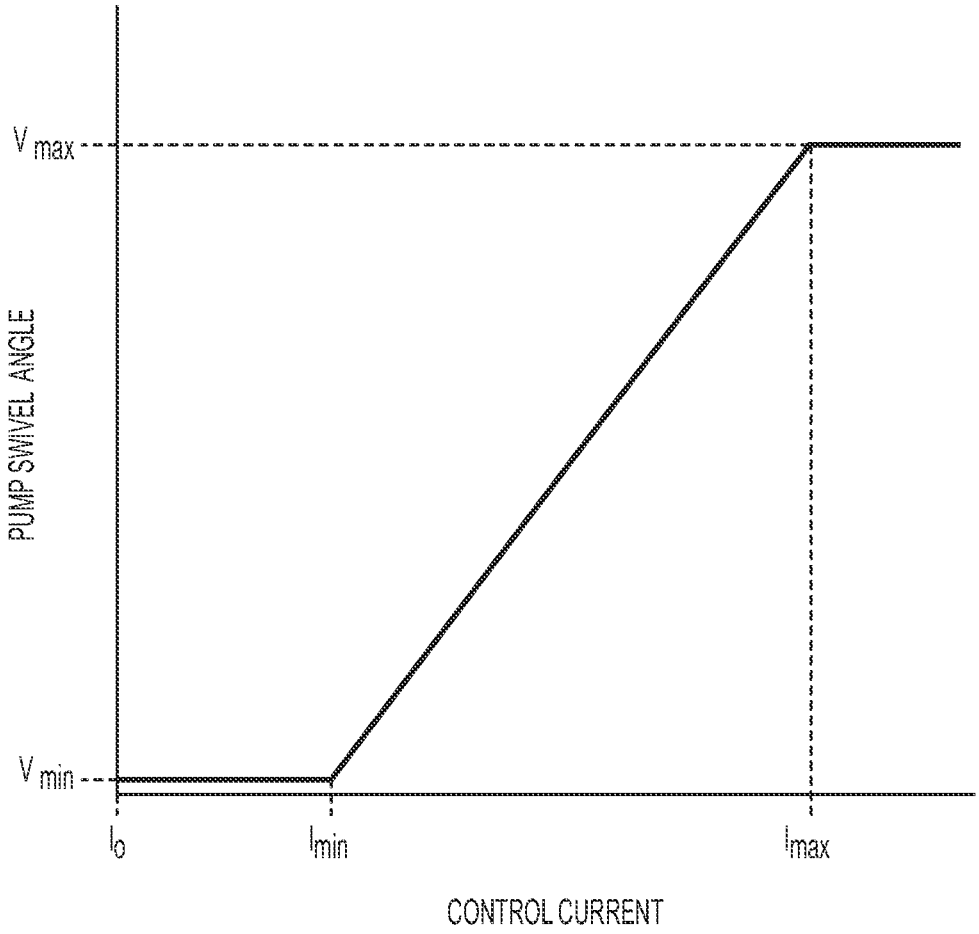
FIG. 4A is a graphical representation of a first exemplary method for controlling the adjustable swash plate of the variable displacement axial piston pump of FIGS. 3A-3C.

According to an exemplary embodiment of the present disclosure, and as shown in FIG. 4A, the swivel angle of swash plate 204 is linearly proportional to the control current delivered from controller 106 to solenoid 162. When the control current from controller 106 is below a certain minimum control current ($I_{min}$), proportional valve 164 remains in the neutral, delivery position 166 (FIG. 2) to position swash plate 204 at its minimum swivel angle ($V_{min}$). As the control current from controller 106 increases above the minimum control current ($I_{min}$), proportional valve 164 shifts from the neutral, delivery position 166 to the vent position 168 (FIG. 2) to proportionally increase the swivel angle of swash plate 204. At a maximum control current ($I_{max}$), proportional valve 164 reaches the vent position 168 (FIG. 2), allowing swash plate 204 to return to its maximum swivel angle ($V_{max}$) to maximize the output from pump 104. Even if controller 106 supplies current in excess of the maximum control current ($I_{max}$), swash plate 204 may remain at its maximum swivel angle ($V_{max}$).

Figure 4B:
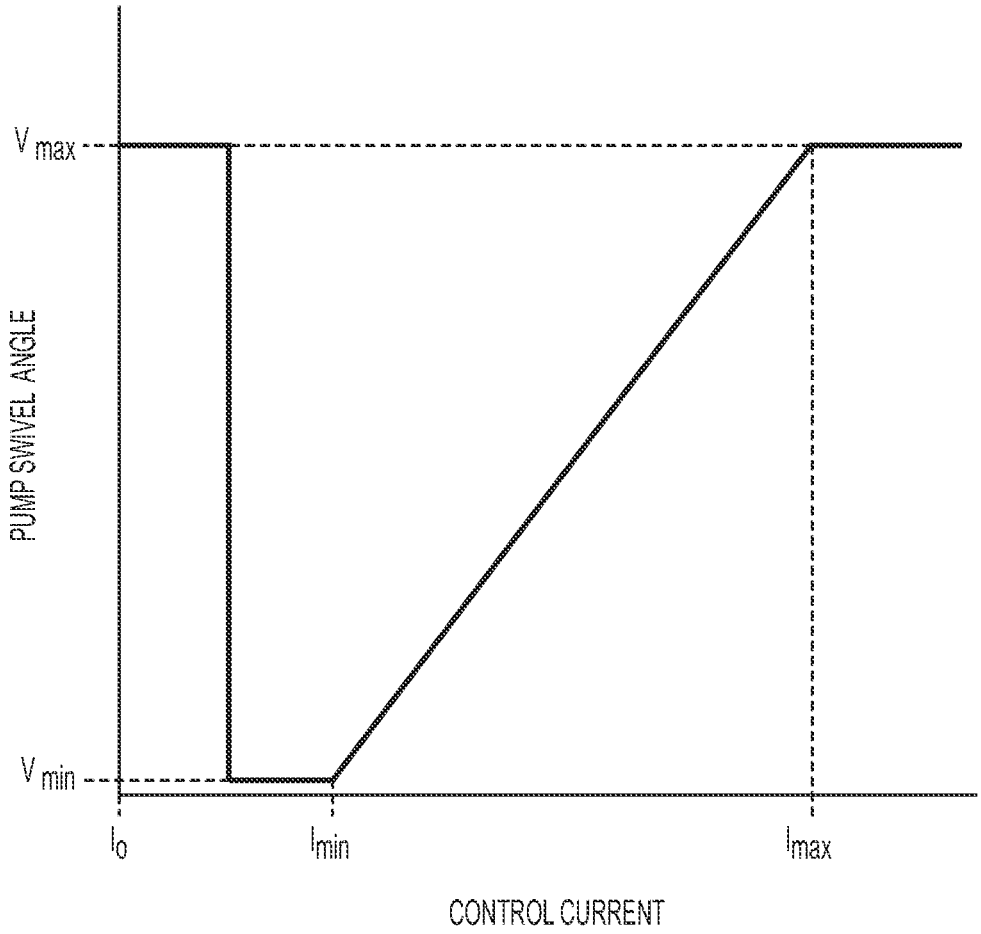
FIG. 4B is a graphical representation of a second exemplary method for controlling the adjustable swash plate of the variable displacement axial piston pump of FIGS. 3A-3C.

Alternatively, and as shown in FIG. 4B, swash plate 204 may be biased at its maximum swivel angle ($V_{max}$) when the control current from controller 106 is zero ($I_0$). In this embodiment, the output from pump 104 may be maximized even in the event of a complete loss of control current ($I_0$). To control swash plate 204 as shown in FIG. 4B, the proportional valve may have a neutral, first vent position (not shown), a delivery position (similar to the delivery position 166 of FIG. 2), and a second vent position (similar to the vent position 168 of FIG. 2). When the control current from controller 106 is below the minimum control current ($I_{min}$), proportional valve 164 remains in the neutral, first vent position (not shown) to position swash plate 204 at its maximum swivel angle ($V_{max}$). Beyond the minimum control current ($I_{min}$), the swivel angle of swash plate 204 may be controlled as set forth above with reference to FIG. 4A.

Returning to FIG. 2, a pressure compensator 180 is provided to overtake the flow controller 160 when the pressure at the outlet of pump 104 reaches a certain threshold pressure. An outlet pressure at or above the threshold pressure may indicate a low demand on pump 104, such as during a stall condition. In response, pressure compensator 180 may de-stroke pump 104 by reducing the swivel angle of swash plate 204, regardless of the current state of flow controller 160. The threshold pressure of pressure compensator 180 may be set lower than the system relief pressure. This way, in a stall condition, pressure compensator 180 de-strokes pump 104 to avoid running hydraulic fluid at its maximum flow rate across a relief valve, as would a gear pump. Thus, pressure compensator 180 may improve the efficiency of circuit 100 by reducing pressure drops, heat loads, and power losses in circuit 100.

The illustrative pressure compensator 180 of FIG. 2 includes a proportional control valve 182 having a neutral, closed position 184 and an open position 186. Control valve 182 shifts from the neutral, closed position 184 to the open position 186 when the pressure at the outlet of pump 104 reaches the threshold pressure, such as 250 bar (3625 psi), for example. When control valve 182 is in the neutral, closed position 184, the pressure in line 190 does not continue to line 192, so flow controller 160 controls the swivel angle of swash plate 204. When control valve 182 is in the open position 186, on the other hand, the pressure in line 190 continues to line 192 and enters port 194 of flow controller 160, forcing swash plate 204 toward the minimum swivel angle ($V_{min}$).

According to an exemplary embodiment of the present disclosure, controller 106 efficiently controls the output from pump 104 by sending an appropriate control current (I) to solenoid 162 of flow controller 160 based on an electrical input from vehicle 10. As set forth below, the control current (I) from controller 106 may vary depending on whether the electrical input to controller 106 indicates that the operator is steering vehicle 10, operating or positioned to operate the front-mounted bucket 30, operating or positioned to operate the rear-mounted bucket 40, and/or operating stabilizers 50, for example. The control current (I) from controller 106 may also vary depending on the performance of engine 14.

When controller 106 electrically detects the actual operation or the potential operation of the rear-mounted bucket 40 via input device 41, controller 106 may send the maximum control current ($I_{max}$) to solenoid 162 of flow controller 160. In one embodiment, input device 41 is a seat position sensor that recognizes when the operator seat in operator cab 20 (FIG. 1) is rotated into a rearward facing position, which would allow the operator to operate the rear-mounted bucket 40. It is also within the scope of the present disclosure that input device 41 may include a user input (e.g., a joystick) that commands actual movement of the rear-mounted bucket 40, a movement sensor positioned to detect actual movement of the user input, a movement sensor positioned to detect actual movement of the rear-mounted bucket 40 or the second boom assembly 42, or another suitable device. As shown in FIG. 4A, the maximum control current ($I_{max}$) corresponds to the maximum swivel angle ($V_{max}$) of swash plate 204 to maximize the output from pump 104. In certain embodiments, driving pump 104 at a speed of about 2200 rpm when swash plate 204 is positioned at its maximum swivel angle ($V_{max}$) outputs hydraulic fluid at a flow rate of about 36 gpm, for example.

Because the operator may operate the front-mounted bucket 30 while driving vehicle 10, the front-mounted bucket 30 may receive less than the maximum supply of hydraulic fluid to balance power between the hydraulics of vehicle 10 and the drive train of vehicle 10. Thus, when controller 106 electrically detects the actual operation or the potential operation of the front-mounted bucket 30 via input device 31, controller 106 may send less than the maximum control current to solenoid 162 of flow controller 160. In one embodiment, input device 31 is a seat position sensor that recognizes when the operator seat in operator cab 20 (FIG. 1) is rotated into a forward facing position, which would allow the operator to operate the front-mounted bucket 30. Input devices 31, 41, may be combined into a single device that senses the position of the operator seat in operator cab 20. It is also within the scope of the present disclosure that input device 31 may include a user input (e.g., a joystick) that commands actual movement of the front-mounted bucket 30, a movement sensor positioned to detect actual movement of the user input, a movement sensor positioned to detect actual movement of the front-mounted bucket 30 or the first boom assembly 32, or another suitable device. In response, pump 104 may deliver hydraulic fluid at less than a maximum flow rate, which improves the efficiency of circuit 100 by balancing power demands in circuit 100 and by reducing pressure drops, heat loads, and power losses in circuit 100.

During the actual operation or the potential operation of the front-mounted bucket 30, controller 106 may send about 80% of the maximum control current ($I_{80\%}$) to solenoid 162 of flow controller 160, for example, which would correspond to about 80% of the maximum swivel angle ($V_{80\%}$) of swash plate 204. In certain embodiments, driving pump 104 at a speed of about 2200 rpm when swash plate 204 is positioned at 80% of the maximum swivel angle ($V_{80\%}$) outputs hydraulic fluid at a flow rate of about 28 gpm, for example. Depending on the desired flow rate of hydraulic fluid to the front-mounted bucket 30, it is also within the scope of the present disclosure that controller 106 may send about 50% of the maximum control current ($I_{50\%}$), 60% of the maximum control current ($I_{60\%}$), 70% of the maximum control current ($I_{70\%}$), or 90% of the maximum control current ($I_{90\%}$) to solenoid 162 of flow controller 160, for example.

Like the front-mounted bucket 30, the hydraulic steering cylinder 114 may require less than the maximum supply of hydraulic fluid. Thus, controller 106 may send less than the maximum control current to solenoid 162 of flow controller 160 to deliver hydraulic fluid at less than the maximum flow rate. As indicated above, delivering hydraulic fluid at less than the maximum flow rate may improve the efficiency of circuit 100 by reducing pressure drops, heat loads, and power losses in circuit 100.

Controller 106 may operate pump 104 in a low-flow condition when controller 106 receives an electrical input indicating that the vehicle 10 is in a transport state. In the transport state, the operator would not be expected to operate the front-mounted bucket 30 or the rear-mounted bucket 40, or at least would not be expected to perform a full speed lift or other full speed movement with the front-mounted bucket 30 or the rear-mounted bucket 40, so pump 104 may supply enough hydraulic fluid to operate the hydraulic steering cylinder 114 without having to supply enough hydraulic fluid to perform the full speed lift or other full speed movement with the front-mounted bucket 30 or the rear-mounted bucket 40. Controller 106 may recognize that vehicle 10 is in the transport state when the operator is driving vehicle 10 at a speed above a predetermined transport speed or in a gear above a predetermined transport gear, for example. The predetermined transport speed may be 6 mph, 8 mph, or 10 mph, for example, because the operator would not be expected to operate the front-mounted bucket 30 or the rear-mounted bucket 40 at speeds above 6 mph, 8 mph, or 10 mph. As shown in FIG. 2, sensor 300 is provided in electrical communication with controller 106. In certain embodiments, sensor 300 is coupled to front and/or rear wheels 16, 18 (FIG. 1) or a transmission output (not shown), for example, to detect the transport speed (i.e., ground speed) of vehicle 10. In other embodiments, sensor 300 is coupled to a transmission (not shown), a transmission control unit (not shown), or a manual shift lever (not shown), for example, to detect the transport gear of vehicle 10.

When vehicle 10 is in the transport state, controller 106 may send about 17% of the maximum control current ($I_{17\%}$) to solenoid 162 of flow controller 160, for example, which would correspond to about 17% of the maximum swivel angle ($V_{17\%}$) of swash plate 204. In certain embodiments, driving pump 104 at a speed of about 2200 rpm when swash plate 204 is positioned at 17% of the maximum swivel angle ($V_{17\%}$) outputs hydraulic fluid at a flow rate of about 6 gpm, for example. Depending on the desired flow rate of hydraulic fluid to the hydraulic steering cylinder 114, it is also within the scope of the present disclosure that controller 106 may send about 10% of the maximum control current ($I_{10\%}$), 20% of the maximum control current ($I_{20\%}$), 30% of the maximum control current ($I_{30\%}$), or 40% of the maximum control current ($I_{40\%}$) to solenoid 162 of flow controller 160, for example.

Controller 106 may also operate pump 104 in a low-flow condition when controller 106 receives an electrical input indicating that the vehicle 10 is in a climbing state. Controller 106 may recognize that vehicle 10 is in the climbing state when the operator is driving vehicle 10 at a speed at or above a predetermined climbing speed and/or in a gear at or above a predetermined climbing gear while engine 14 is operating at a load at or above a predetermined climbing load. As discussed above, the speed or gear of vehicle 10 may be detected using sensor 300, for example. The load on engine 14 may be detected using engine control unit 302. The predetermined climbing speed may be about 5 mph, the predetermined climbing gear may be third gear, and the predetermined climbing load may be about 100%, for example. In this example, when vehicle 10 is traveling at or above this predetermined climbing speed (5 mph) and/or at or above the predetermined climbing gear (third gear) and engine 14 is operating at this predetermined climbing load (100%), controller 106 may assume that vehicle 10 is climbing a hill. When vehicle 10 is in the climbing state, controller 106 may allot power from engine 14 to the transmission to facilitate climbing the hill by sending less than the maximum control current to solenoid 162 of flow controller 160. Controller 106 may respond to the climbing state in the same manner or a similar manner as controller 106 responds to the above-described transport state.

When controller 106 electrically detects a slow transient response of engine 14 (i.e., when the actual speed of engine 14 is less than the commanded speed of engine 14), controller 106 may de-stroke pump 104 by decreasing the control current to solenoid 162 of flow controller 160. For example, controller 106 may decrease the control current to solenoid 162 of flow controller 160 by about 20%, 30%, 40%, 50%, or more. As shown in FIG. 2, controller 106 is in electrical communication with engine control unit 302 or another suitable component to compare the actual speed of engine 14 to the commanded speed of engine 14. Until engine 14 recovers, the hydraulic components of vehicle 10 will receive hydraulic fluid at a reduced flow rate.

The open-center circuit 100 of the present disclosure may be more affordable than a closed-center circuit with a complex load-sense system. Rather than having to monitor the circuit pressure to adjust the output of pump 104, circuit 100 may receive electrical inputs from device 31, device 41, sensor 300, and/or engine control unit 302, for example. Also, flow controller 160 and pressure compensator 180 of circuit 100 allow for power control and efficiency gains.

While this invention has been described as having preferred designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this disclosure pertains and which fall within the limits of the appended claims.

The invention claimed is:

1. A work vehicle including:

a chassis;

a plurality of traction devices positioned to support the chassis on the ground;

a power source;

a variable displacement pump that is driven by the power source to supply hydraulic fluid;

a pump control valve operably coupled to the pump and configured to adjust the displacement of the pump;

at least one work tool moveably coupled to the chassis;

at least one hydraulic actuator configured to move the at least one work tool relative to the chassis;

an open-center actuator control valve in communication with the pump and the at least one hydraulic actuator, the open-center actuator control valve directing hydraulic fluid away from the at least one hydraulic actuator when in a neutral position and directing hydraulic fluid to the at least one hydraulic actuator when in an actuated position to move the at least one work tool relative to the chassis;

a hydraulically-controlled proportional valve disposed in fluid communication between the pump and the at least one hydraulic actuator, the proportional valve being in selective fluid communication with the open-center actuator control valve, where the proportional valve is movable between at least two positions in which in at least one position the proportional valve is adapted to control flow to the at least one hydraulic actuator;

a hydraulic steering actuator that is configured to steer the plurality of traction devices; and a controller in electrical communication with the pump control valve, the controller receiving an electrical input from the work vehicle and sending an electrical control signal to the pump control valve based on the electrical input to adjust the flow rate of hydraulic fluid supplied to the open-center actuator control valve;

wherein, when the electrical input indicates that the work vehicle is operating in a transport state or a climbing state, the controller sends less than a maximum control signal to the pump control valve to direct less than a maximum flow rate of hydraulic fluid the hydraulic steering actuator.

2. The work vehicle of claim 1, wherein the pump includes an adjustable swash plate, the position of the swash plate being linearly proportional to the electrical control signal sent from the controller to the pump control valve.

3. The work vehicle of claim 1, wherein the pump control valve uses an outlet pressure of the pump to adjust the displacement of the pump.

4. The work vehicle of claim 1, further including a pressure compensator that overtakes the pump control valve when an outlet pressure of the pump reaches a threshold pressure.

5. The work vehicle of claim 1, wherein, when the electrical input indicates actual operation or potential operation of the at least one hydraulic actuator, the controller sends a maximum control signal to the pump control valve during to direct a maximum flow rate of hydraulic fluid to the at least one hydraulic actuator.

6. The work vehicle of claim 1, further including a second work tool and a second hydraulic actuator, wherein, when the electrical input indicates actual operation or potential operation of the second hydraulic actuator, the controller sends less than a maximum control signal to the pump control valve to direct less than a maximum flow rate of hydraulic fluid to the second hydraulic actuator.

7. The work vehicle of claim 6, wherein the controller sends about 80% of the maximum control signal to the pump control valve when the electrical input indicates actual operation or potential operation of the second hydraulic actuator.

8. The work vehicle of claim 1, wherein the controller sends less than 20% of the maximum control signal to the pump control valve when the electrical input indicates that the work vehicle is operating in the transport state or the climbing state.

9. The work vehicle of claim 1, wherein the power source includes an engine, the controller reducing the electrical control signal to the pump control valve when the electrical input indicates that an actual speed of the engine is less than a commanded speed of the engine.

10. The work vehicle of claim 1, further comprising:

a second work tool moveably coupled to the chassis;

a second hydraulic actuator configured to move the second work tool relative to the chassis;

wherein, the proportional valve is disposed in fluid communication with the second hydraulic actuator;

further wherein, in a second position the proportional valve controls flow from the pump to the second hydraulic actuator, where the second position is different from the at least one position.

11. The work vehicle of claim 1, further comprising:

an actuator valve for operating the at least one hydraulic actuator, the actuator valve being movable between at least a neutral position and another position; and a fluid tank in fluid communication with the pump;

wherein, in the neutral position the actuator valve is positioned such that an open flow path is formed from the actuator valve and the fluid tank so that hydraulic fluid flows away from the at least one hydraulic actuator to the fluid tank.

12. A work vehicle including:

a chassis;

a plurality of traction devices positioned to support the chassis on the ground;

a power source;

at least a first work tool and a second work tool moveably coupled to the chassis;

a hydraulic circuit including:

a variable displacement pump that is driven by the power source to supply hydraulic fluid;

a pump control valve operably coupled to the pump and configured to adjust the displacement of the pump;

at least a first hydraulic actuator and a second hydraulic actuator, the first hydraulic actuator configured to move the first work tool and the second hydraulic actuator configured to move the second work tool relative to the chassis;

an open-center actuator control valve in communication with the pump and the at least one hydraulic actuator, the open-center actuator control valve directing hydraulic fluid away from the at least one hydraulic actuator when in a neutral position and directing hydraulic fluid to the at least one hydraulic actuator when in an actuated position to move the at least one work tool relative to the chassis; and a hydraulically-controlled proportional valve disposed in fluid communication between the pump and the at least one hydraulic actuator, the proportional valve being in selective fluid communication with the open-center actuator control valve, where the proportional valve is movable between at least two positions in which in at least one position the proportional valve is adapted to control flow to the at least one hydraulic actuator; and an electrical circuit including:

at least one input device; and a controller in electrical communication with the at least one input device and the pump control valve, the controller receiving an electrical input from the at least one input device and sending an electrical control signal to the pump control valve based on the electrical input from the at least one input device to adjust the flow rate of hydraulic fluid supplied to the open-center actuator control valve;

wherein, when the electrical input indicates actual operation or potential operation of the second hydraulic actuator, the controller sends less than a maximum control signal to the pump control valve to direct less than a maximum flow rate of hydraulic fluid to the second hydraulic actuator.

13. The work vehicle of claim 12, wherein the pump includes an adjustable swash plate, the position of the swash plate being linearly proportional to the electrical control signal sent from the controller to the pump control valve.

14. The work vehicle of claim 13, wherein the swash plate of the pump is spring-biased at a maximum swivel angle.

15. The work vehicle of claim 14, wherein the pump control valve adjusts the swash plate of the pump when an outlet pressure of the pump overcomes the spring-bias of the swash plate.

16. The work vehicle of claim 12, wherein the at least one input device includes one of:

a movement sensor positioned to detect movement of a rotatable operator seat;

a user input operably coupled to the at least one work tool to command movement of the at least one work tool;

a movement sensor positioned to detect movement of the user input; and a movement sensor positioned to detect movement of the at least one work tool.

17. The work vehicle of claim 16, further including a second input device in electrical communication with the controller, the second input device including one of:

a sensor configured to detect a transport speed of the work vehicle; and a sensor configured to detect a transport gear of the work vehicle.

18. The work vehicle of claim 16, further including a second input device in electrical communication with the controller, the second input device configured to detect an actual speed of the power source and a commanded speed of the power source.

19. The work vehicle of claim 12, wherein the at least one work tool includes a front-mounted bucket, the work vehicle further including a second work tool in the form of a rear-mounted bucket.

20. A work vehicle including:

a chassis;

a plurality of traction devices positioned to support the chassis on the ground;

a power source;

a variable displacement pump that is driven by the power source to supply hydraulic fluid;

a pump control valve operably coupled to the pump and configured to adjust the displacement of the pump;

a first work tool and a second work tool, the first work tool and second work tool movably coupled to the chassis;

a first hydraulic actuator configured to move the first work tool relative to the chassis; a second hydraulic actuator configured to move the second work tool relative to the chassis;

an open-center actuator control valve in communication with the pump and the first and second hydraulic actuators, the open-center actuator control valve directing hydraulic fluid away from first or second hydraulic actuator when in a neutral position and directing hydraulic fluid to the first or second hydraulic actuator when in an actuated position to move the first or second work tool relative to the chassis;

a controller in electrical communication with the pump control valve, the controller receiving an electrical input from the work vehicle and sending an electrical control signal to the pump control valve based on the electrical input to adjust the flow rate of hydraulic fluid supplied to the open-center actuator control valve;

wherein, when the electrical input indicates actual operation or potential operation of the second hydraulic actuator, the controller sends less than a maximum control signal to the pump control valve to direct less than a maximum flow rate of hydraulic fluid to the second hydraulic actuator.

* * * * *